US010138734B2

(12) United States Patent
Jaureguiberry et al.

(10) Patent No.: US 10,138,734 B2
(45) Date of Patent: Nov. 27, 2018

(54) TURBINE RING FOR A TURBOMACHINE

(71) Applicant: SAFRAN HELICOPTER ENGINES, Bordes (FR)

(72) Inventors: Carole Jaureguiberry, Labenne (FR); Manuel Silva, Gelos (FR)

(73) Assignee: SAFRAN HELICOPTER ENGINES, Bordes (FR)

( * ) Notice: Subject to any disclaimer, the term of this patent is extended or adjusted under 35 U.S.C. 154(b) by 195 days.

(21) Appl. No.: 14/774,417

(22) PCT Filed: Mar. 13, 2014

(86) PCT No.: PCT/FR2014/050579
§ 371 (c)(1),
(2) Date: Sep. 10, 2015

(87) PCT Pub. No.: WO2014/140493
PCT Pub. Date: Sep. 18, 2014

(65) Prior Publication Data

US 2016/0024926 A1 Jan. 28, 2016

(30) Foreign Application Priority Data

Mar. 14, 2013 (FR) ..... 13 52257

(51) Int. Cl.
*F01D 25/24* (2006.01)
*F01D 5/04* (2006.01)
(Continued)

(52) U.S. Cl.
CPC ..... *F01D 5/04* (2013.01); *F01D 9/04* (2013.01); *F01D 11/005* (2013.01);
(Continued)

(58) Field of Classification Search
CPC ..... F01D 9/04; F01D 11/005; F01D 11/10; F01D 11/08; F01D 25/246; F01D 25/12;
(Continued)

(56) References Cited

U.S. PATENT DOCUMENTS 5,423,659 A 6/1995 Thompson
5,738,490 A 4/1998 Pizzi
(Continued)

FOREIGN PATENT DOCUMENTS

GB 2 417 528 3/2006
JP 9-228804 A 9/1997
(Continued)

OTHER PUBLICATIONS

Chinese Office Action dated Jun. 14, 2017 in Chinese Patent Application No. 201480014008.1 (submitting English translation only).
(Continued)

*Primary Examiner* — Phutthiwat Wongwian
*Assistant Examiner* — Kelsey Stanek
(74) *Attorney, Agent, or Firm* — Oblon, McClelland, Maier & Neustadt, L.L.P.

(57) ABSTRACT

A turbine engine turbine ring, in particular for a helicopter, in which vibratory behavior is reduced. The turbine ring includes an essentially cylindrical support, and one or more sectors forming a circle configured to define a segment of an air passage, each sector being fastened to the support by an attachment device, wherein the attachment device includes a hook portion belonging to the support and projecting towards the sector, and a hook portion belonging to the sector and projecting towards the support, the hook portions of the support and of the sector being configured to co-operate in order to fasten the sector to the support, the ring further includes a damper device provided within the attach-
(Continued)

ment device and stressed radially between a portion of the sector and a portion of the support so as to damp relative movements between the sector and the support.

11 Claims, 5 Drawing Sheets

(51) Int. Cl.
*F01D 9/04* (2006.01)
*F01D 11/00* (2006.01)

(52) U.S. Cl.
CPC ..... *F01D 25/246* (2013.01); *F05D 2230/60* (2013.01); *F05D 2240/11* (2013.01); *F05D 2240/40* (2013.01)

(58) Field of Classification Search
CPC .... F01D 5/04; F05D 2240/11; F05D 2240/40; F05D 2240/55; F05D 2240/80; F05D 2240/81; F05D 2230/60; F04D 29/083; Y02T 50/67; Y02T 50/676
USPC ..... 416/182, 189, 192; 415/170.1, 1, 173.1, 415/139, 173.3, 173.5, 174.2, 174.5, 180, 415/209.2
See application file for complete search history.

(56) References Cited

U.S. PATENT DOCUMENTS 5,762,472 A 6/1998 Pizzi et al.
5,988,975 A * 11/1999 Pizzi ..... F01D 11/005 415/139
6,237,921 B1 5/2001 Liotta et al.
2004/0005216 A1* 1/2004 Suzumura ..... F01D 11/08 415/173.3
2005/0123389 A1* 6/2005 Morris ..... F01D 9/04 415/1
2006/0038358 A1 2/2006 James
2006/0083607 A1* 4/2006 Synnott ..... F01D 11/08 415/173.1
2006/0159549 A1* 7/2006 Durocher ..... F01D 11/005 415/170.1
2012/0076659 A1 3/2012 Robertson

FOREIGN PATENT DOCUMENTS

JP 2004-36443 A 2/2004
JP 2010-151046 A 7/2010
WO 00 12920 3/2000
WO WO 2013/024674 A1 2/2013

OTHER PUBLICATIONS

Combined Chinese Office Action and Search Report dated Nov. 30, 2016 in Patent Application No. 201480014008.1 (with English translation and English translation of categories of cited documents).
International Search Report dated Jul. 7, 2014 in PCT/FR2014/050579 filed Mar. 13, 2014.
Office Action dated Jan. 9, 2016 in Japanese Patent Application No. 2015-562286 (with English language translation), 9 pages.

* cited by examiner

FIG.7A
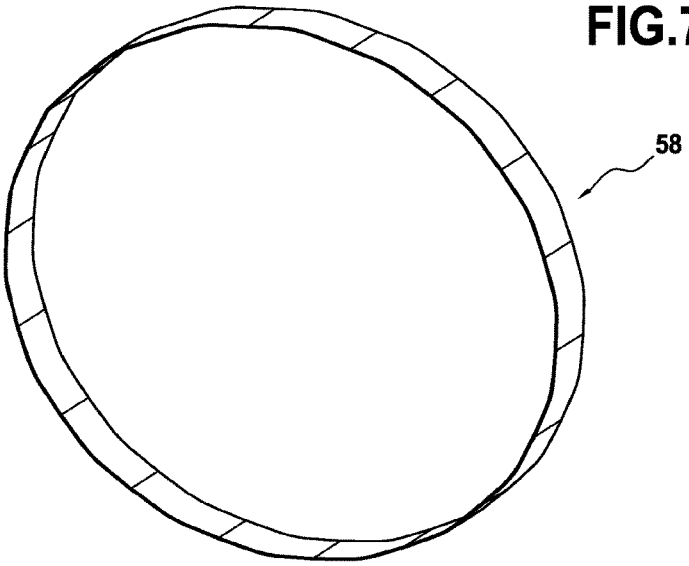
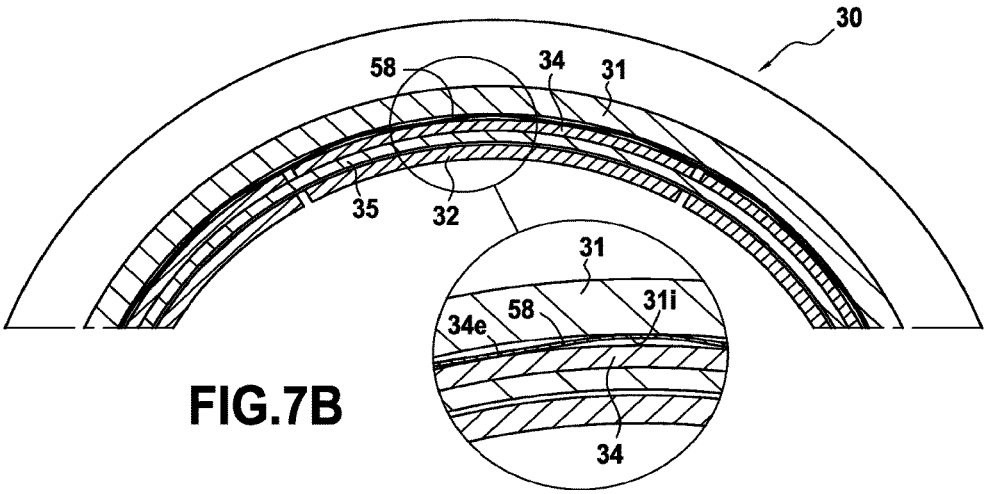
FIG.7B

TURBINE RING FOR A TURBOMACHINE

FIELD OF THE INVENTION

The present invention relates to a turbine ring for a turbine engine, in particular for a helicopter.

Such a ring may be used in any type of turbine engine for the purpose of reducing the vibratory behavior that can appear within such rings.

STATE OF THE PRIOR ART

In a conventional helicopter turbine engine, a high pressure turbine ring generally comprises a circle of sectors fastened to a ring support. As can be seen in FIG. 2, the sectors are provided for this purpose with hooks suitable for co-operating with hooks of the support.

In contact with the air stream, the ring sectors are subjected to stresses from the aerodynamic stream, which stresses are caused in particular by the wake from upstream and downstream stages, and this can lead to vibratory behavior. In particular, in the operating range of the engine, the sectors can enter into resonance, a phenomenon that can lead to cracking due to vibratory fatigue or to phenomena of premature wear.

At present, in order to achieve better control over such vibratory behavior, one technique for improvement consists in revising the specific shape of the sectors. Nevertheless, designing specific shapes is complex, given the imposed mechanical and aerodynamic stresses.

Another known solution, which is easier to implement consists in reducing clearances when assembling rings. Nevertheless, radial clamping between the sectors and the support leads to additional mechanical stresses on the fastener hooks, and as a result they can suffer high levels of plastic deformation, and possibly also cracking. In addition, such an operation makes the procedure for mounting rings more complex, thereby increasing production and maintenance costs.

There therefore exists a real need for a turbine ring, and for a turbine engine, avoiding at least to some extent the drawbacks that are inherent to the above-described known configurations.

SUMMARY OF THE INVENTION

The present description provides a turbine ring comprising an essentially cylindrical support, and one or more sectors forming a circle configured to define a segment of an air passage, each sector being fastened to the support by an attachment device, wherein the attachment device comprises a hook portion belonging to the support and projecting towards the sector, and a hook portion belonging to the sector and projecting towards the support, the hook portions of the support and of the sector being configured to co-operate in order to fasten the sector to the support; the ring further comprises a damper device provided within the attachment device and stressed radially between a portion of the sector and a portion of the support so as to damp relative movements between the sector and the support; the damper device comes into contact in alternation, in the circumferential direction, with the inner surface of the support and with the outer surface of the hook portion of the sector.

By using this damper device that maintains at least one pressure zone on said portion of the sector and at least one pressure zone on said portion of the support, relative movements between the sector and the support are constrained and thus smaller. In addition, they are damped radially by friction of the sector and/or the support against the damper device. This friction dissipates the energy of the sectors so it no longer accumulates, thereby reducing the risk of the sectors becoming resonant over the operating range, and thus greatly limiting damage due to vibratory fatigue.

In addition, because of the damper device elastically constraining relative movements between the sector and the support, it is possible to maintain radial clearance between the sector and the support that is sufficient for limiting mechanical stresses of the oligocyclic fatigue type acting on the sector and the support, thereby increasing their lifetime.

The damper device also makes it possible to release the sector from its secondary object of limiting vibration. Under such circumstances, its shape may be selected more freely: its shape can thus be simplified, thereby leading to cost reductions, or it may be optimized more effectively with respect to other functions of the sector.

Furthermore, the damper device facilitates assembling the sector on the support by acting as a guide of radial dimension that corresponds substantially to the clearance that is to be left between the sector and the support: the sector can thus be pressed against the damper device in order to ensure it is accurately positioned. This improves positioning accuracy and repeatability, thereby leading to better control over clearance at the tips of the blade and reducing machining non-compliances.

Such a configuration in which the damper device comes into contact in alternation in the circumferential direction with the inner surface of the support and with the outer surface of the hook portion of the sector ensures that the damper device can be shaped simply, since it does not have any need to provide continuous and simultaneous contact with the inner surface of the support and the outer surface of the hook portion of the sector.

In certain embodiments, the damper device is also configured to press a portion of the sector against a portion of the support. Under such circumstances, relative movements of the sector and of the support can also be damped by friction of the sector against the support.

In certain embodiments, the support is also fastened by means of a second attachment device analogous to the first attachment device; it is also provided with a second damper device that is provided within the second attachment device, and that is analogous to the first damper device.

In certain embodiments, the damper device comprises a flexible blade. This flexible blade is preferably an element made of sheet metal. Such flexible sheet metal is inexpensive, easy to shape, and presents stiffness appropriate for such damping.

In certain embodiments, the damper device is stressed radially between said portion of the sector and said portion of the support over its entire length. Under such circumstances, the stresses exerted on the sector and on the support are distributed over the entire length of the sector, and in addition damping is uniform over the entire sector.

In certain embodiments, the damper device is substantially smooth over its entire length with the section of localized indentations distributed along its length. These may be constituted in particular by spherical bulges, e.g. made by stamping.

In other embodiments, the device comprises an element made of corrugated sheet metal.

In certain embodiments, the damper device is provided between an outer surface of the hook portion of the sector and an inner surface of the support. Such a configuration is easy to assemble, furthermore, in this configuration, the two hook portions are pressed against each other, thereby strengthening the fastening of the sector and improving its damping.

In other embodiments, the damper device is provided between an inner surface of the hook portion of the support and an outer surface of the sector.

In certain embodiments, the damper device is received at least in part in a groove formed in a portion of the sector. By means of this groove, it is possible to mount the damper device on the sector before assembling it on the support, thereby facilitating the procedure for assembly. In addition, this makes it possible to reduce the radial clearance between the sector and the support.

In other embodiments, the damper device is received at least in part in a groove that is formed in a portion of the support.

In certain embodiments, the damper device enfolds at least the distal portion of the hook portion of the support. The damper device is thus easily put into place and remains in position even in the absence of the sector.

In certain embodiments, the damper device is configured so as to maintain permanently, firstly at least one pressure zone on the outer surface of the hook portion of the support and a pressure zone on its inner surface, and secondly at least one pressure zone on the inner surface of the hook portion of the sector and/or a pressure zone on an outer surface of the sector. The damper device is thus clipped around the end of the hook, thereby ensuring that it is put into position and held stationary.

In other embodiments, the damper device enfolds at least the distal portion of the hook portion of the sector.

In certain embodiments, the damper device is a single piece extending continuously all along the circumference of the ring formed by the sector(s). Nevertheless, it may be interrupted by a gap arranged in an azimuth plane of the device.

In other embodiments, the damper device is divided into a plurality of sections that follow one another all along the circumference of the circle formed by the sector(s).

In certain embodiments, a section of the damper device is associated with each sector.

In other embodiments, each section of the damper device is associated with a plurality of sectors.

In certain embodiments, the damper device is configured also to provide sealing between the support and the sector. For example, it may be a braided gasket.

In certain embodiments, the damper device is secured either to the sector or to the support. This securing is preferably performed by welding.

The present description also provides a turbine engine including at least one ring in accordance with any of the above-described embodiments.

In certain embodiments, the turbine engine is a helicopter turboshaft engine. Said ring is fitted to the linked turbine and/or to the free turbine.

In certain embodiments, the turbine engine is an airplane turbojet.

The above-mentioned characteristics and advantages, and others, appear on reading the following detailed description of embodiments of the proposed ring and turbine engine. This detailed description makes reference to the accompanying drawings.

BRIEF DESCRIPTION OF THE DRAWINGS

The accompanying drawings are diagrammatic and seek above all to illustrate the principles of the invention.

In the drawings, from one figure to another, elements (or portions of an element) that are identical are identified by the same reference signs. Furthermore, elements (or portions of an element) belonging to different embodiments but having analogous functions are identified in the figures by numerical references incremented by 100, 200, etc.

FIG. 7A shows another variant of the damper device.

FIG. 7B is a radial section view of the FIG. 2 ring provided with the FIG. 7A damper device.

DETAILED DESCRIPTION OF EMBODIMENTS

In order to make the invention more concrete, example embodiments of turbine rings are described in detail below, with reference to the accompanying drawings. It should be recalled that the invention is not limited to these embodiments.

Figure 1:
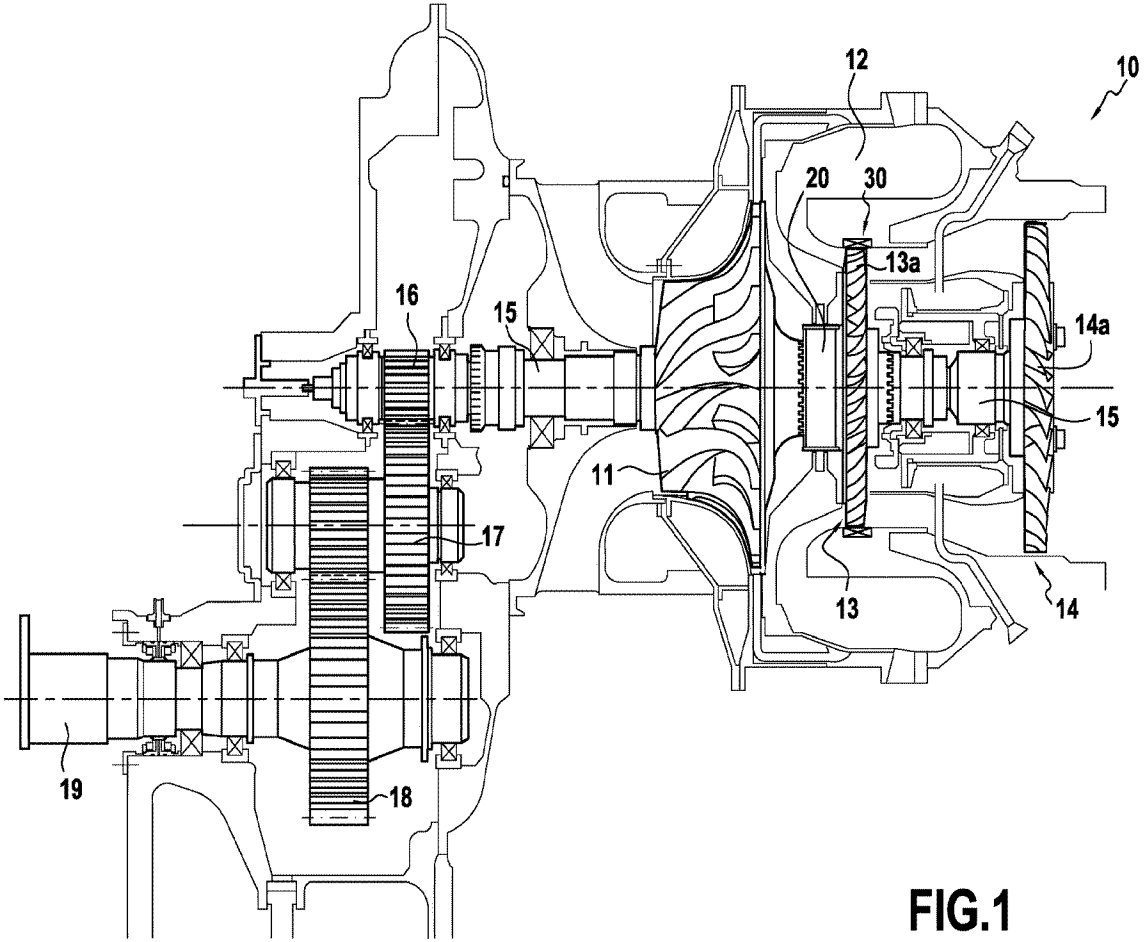
FIG. 1 is an overall view of an example of a helicopter turboshaft engine.

FIG. 1 shows a turbine engine 10, specifically a helicopter turboshaft engine. In conventional manner, the turboshaft engine 10 comprises a compressor 11, a gas generator 12, and both linked and free turbines 13 and 14, also referred to as the high pressure turbine and the low pressure turbine, which are driven in rotation by the stream of burnt gas leaving the combustion chamber 12. The free turbine 14 comprises a turbine wheel 14*a* that is fastened to one of the ends of a shaft 15. The other end of the shaft 15 has a primary gearwheel 16 that meshes with an intermediate gearwheel 17. The intermediate gearwheel 17 meshes with an outlet gearwheel 18. The intermediate gearwheel 17 and the outlet gearwheel 18 are toothed wheels forming portions of the speed-reducing gearbox of the turbine engine 10. The outlet gearwheel 18 is connected to an outlet shaft 19 for coupling to the main gearbox of the helicopter (not shown). The linked turbine 13 has a turbine wheel 13*a* that is connected to the compressor 11 via a drive shaft 20. The linked turbine 13 is also fitted with a turbine ring 30 that defines the air flow passage and that faces the blades of the turbine wheel 13*a*.

Figure 2:
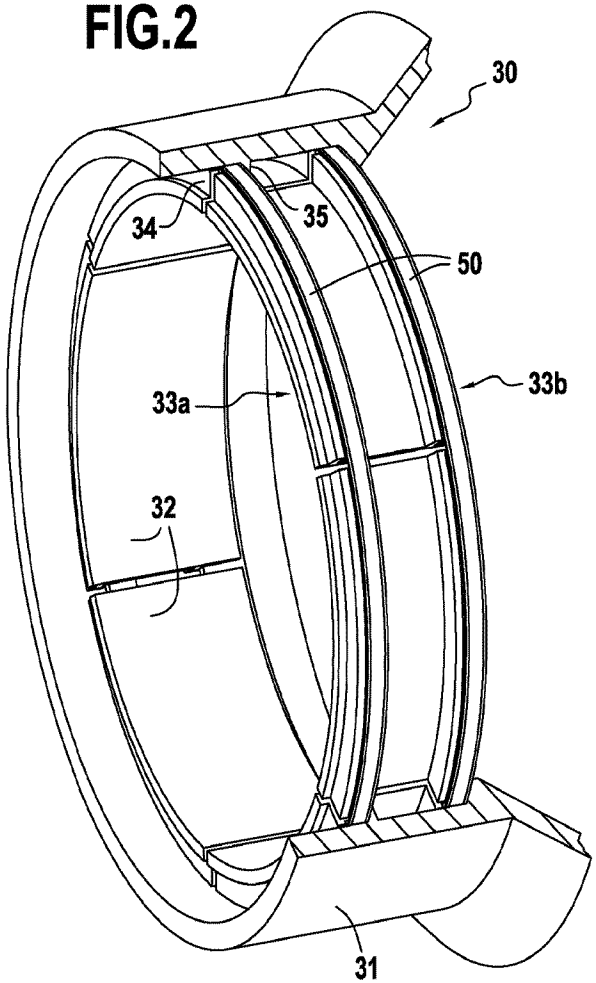
FIG. 2 is a cutaway perspective view of a first example of a turbine ring.

FIG. 2 shows a first embodiment of such a turbine ring 30. It comprises a generally cylindrical ring support 31 forming an integral portion of the casing of the turbine 13, and a circle of ring sectors 32 fastened to the ring support 31 so as to define the air flow passage through the turbine 13.

Figure 3:
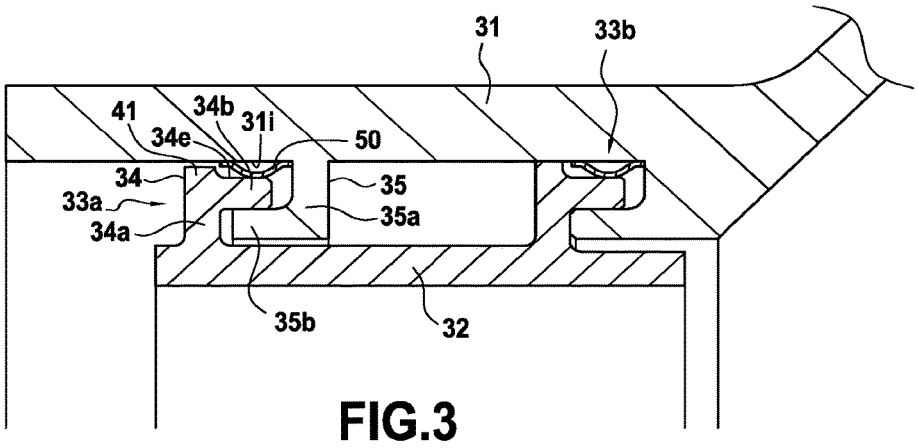
FIG. 3 is an axial section view of the FIG. 2 ring.

As can be seen more clearly in FIG. 3, each ring sector 32 is fastened to the ring support 31 by using attachment devices 33*a* and 33*b*: in each attachment device 33*a*, 33*b*, a hook 34 of the sector 32 extends towards the support 31 in order to co-operate with a hook 35 of the support 31 extending towards the ring sector 32. Each of these hooks 34 of the sector 32 thus possesses a radial portion 34*a* and a tangential portion 34*b*, which together extend continuously all along each sector 32. Each hook 35 of the support 31 also has a radial portion 35*a* and a tangential portion 35*b*, which together extend circumferentially in continuous manner all along the circumference of the support 31.

In this first embodiment, the hooks 34 of the sector 32 are provided with respective ribs 41 projecting from the outside surface 34*e* of the hook 34 at least partially in line with the radial portion 34*a* of the hook 34. This rib 41 serves to provide radial clearance between the outer surface 34*e* of the hook 34 and the inner surface 31*i* of the support 31 so as to enable a damper 50 to be put into place.

The damper 50 is a flexible blade, preferably made of sheet metal, being substantially V-shaped in this axial section plane: this shape in section is substantially constant all along the length of the damper 50. The damper 50 is thus stressed between the outer surface 34*e* of the hook 34 of the sector 32 and the inner surface 31*i* of the support 31 so as to exert firstly pressure on the hook 34 via its central zone, and secondly pressure on the support 31 via its two ends.

The stiffness of this damper 50 may be adjusted by adjusting the thickness, the length, and more generally the shape of the damper. In particular, in this example, the damper is made using sheet metal having a thickness of about 0.2 millimeter (mm). Its material may also be selected as a function of the desired stiffness. Specifically, the metal sheet may be made of Inconel 718.

As can be seen in FIG. 2, in this example, the damper 50 of each attachment device 33*a*, 33*b* is a single piece extending continuously all along the ring support 31, with the exception of a gap arranged in an azimuth plane of the damper 50 so as to make it easier to put into place in the turbine 13. Nevertheless, in other examples, the damper could be continuous all along the ring support without including a gap.

Numerous variants of this first embodiment are possible. For example, in the variant of FIG. 4, a groove 42 is formed in the outer surface 34*e* of the hook 34 of the ring sector 32. Such a groove 42 serves to receive the damper 52. The depth of the groove 42 is nevertheless shallower than the height of the damper 52 so that the damper 52 projects beyond the outer surface 34*e* of the hook 34: the damper 52 is thus stressed between the support 31 and the hook 34 of the sector 32.

Figure 4:
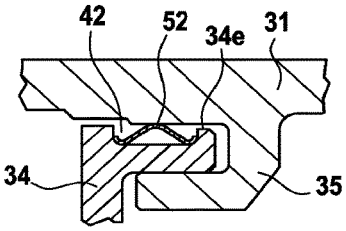
FIG. 4 shows a variant of the FIG. 2 ring.

In addition, FIG. 4 shows that it is generally possible to mount the damper 52 in a position that is the other way up relative to that of the damper 50 in FIG. 3: under such circumstances, the damper 52 exerts pressure on the inner surface 31*i* of the support 31 via its central zone, while exerting pressure on the hook 34 of the sector 32 via its two ends.

Figure 5:
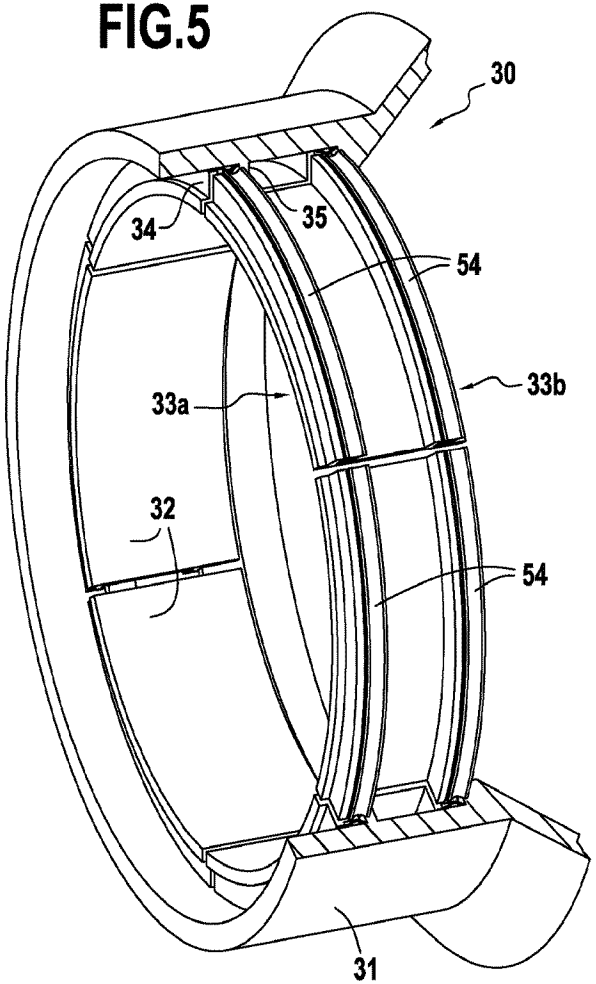
FIG. 5 is a cutaway perspective view of another variant of the FIG. 2 ring.

FIG. 5 shows another variant of the first embodiment of the ring 30. In this variant, the damper 54 is not a single piece but is made up of sectors: specifically, the divisions of the damper 54 are designed to correspond with the divisions of the ring sectors 32 so that a damper section 54 is associated with each sector 32. Nevertheless, the damper 54 could naturally be divided in some other way.

Figure 6A:
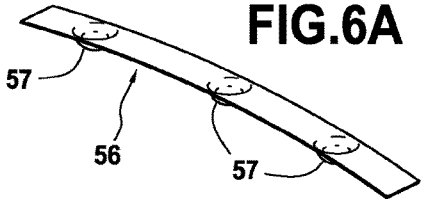
FIG. 6A shows a variant of the damper device.
Figure 6B:
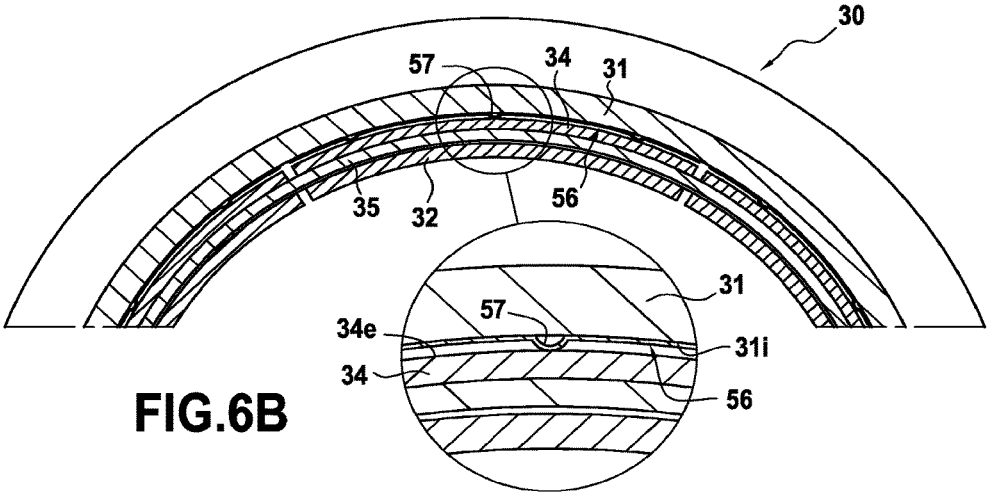
FIG. 6B is a radial section view of the FIG. 2 ring provided with the FIG. 6A damper device.

FIGS. 6A and 6B show another variant of the first embodiment of the turbine ring 30. Unlike the embodiment of FIG. 3, the damper 56 is not shaped over its entire length. In this variant, the damper 56 is a flexible blade, preferably made of sheet metal, that is substantially smooth over its entire length, with the exception of indentations 57 formed in regular manner in its smooth surface. As can be seen in FIG. 6B, the damper 56 is configured so that its outer surface presses against the inner surface 31*i* of the ring support 31, while the inner ends of the indentations 57 press against the outer surface 33*e* of the hook 33 of the ring sector 32 so that the damper device 56 makes contact in alternation in the circumferential direction with the inner surface 31*i* of the support 31 and with the outer surface 33*e* of the hook 33 of the ring sector 32.

FIGS. 7A and 7B show a last variant of the first embodiment of the turbine ring 30. In this variant, the damper 58 is a corrugated sheet with undulations enabling the damper 58 to come into contact in alternation along its circumferential direction with the inner surface 31*i* of the support 31 and the outer surface 34*e* of the hook 33 of the ring sector 32.

Figure 8A:
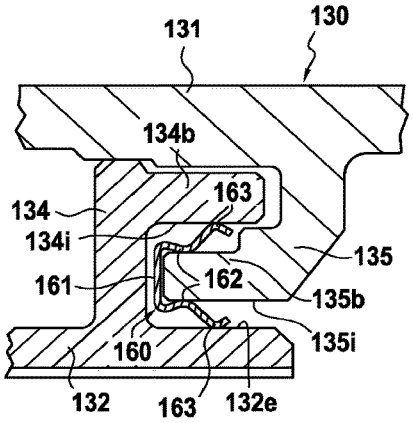
FIG. 8A is an axial section view of a second embodiment of the ring.

FIG. 8A shows a second embodiment of the turbine ring 130. In this second embodiment, the damper 160 is a flexible blade, preferably made of sheet metal, that is substantially U-shaped in this axial section plane, being engaged around the distal portion of the hook 135 of the support 131, i.e. at the end of the tangential portion 135*b* of the hook 135. The damper 160 thus has a plane portion 161 pressed against the distal surface of the hook 135, from which there extend the two branches of the damper 160. In a first portion 162, the two branches extend towards each other so as to clamp onto the distal portion of the hook 135, after which, in a second portion 163, the two branches extend apart from each other so as to press firstly against the inner surface 134*i* of the tangential portion 134*b* of the hook 134, and secondly against the outer surface 132*e* of the ring sector 132. In this example, the two branches of the damper 160 are symmetrical.

Figure 8B:
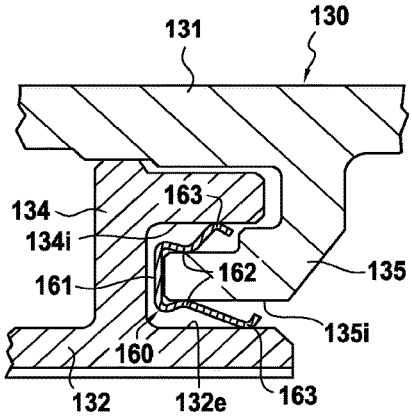
FIGS. 8B and 8C are axial section views of variants of the FIG. 8A ring.

FIG. 8B shows a variant of the second embodiment of the turbine ring 130. In this variant, in order to obtain different stiffness, the inner branch of the damper 160 is longer than its outer branch. Thus, the second portion 163 of the inner branch presses against the outer surface 132*e* of the ring sector 132 further downstream than in the variant of FIG. 8A.

Figure 8C:
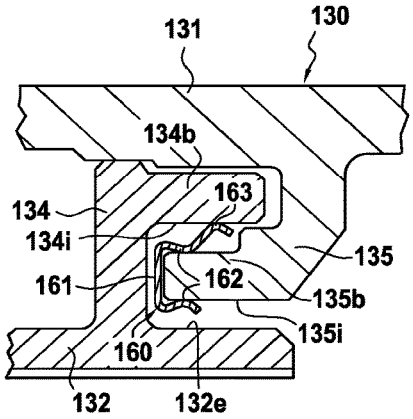

FIG. 8C shows another variant of the second embodiment of the ring turbine 130. In this variant, the inner branch of the damper 160 has a tapering first portion 162 that presses against the inner surface 135*i* of the hook 135, but does not have a second portion pressing against the outer surface 132*e* of the ring sector 132.

Figure 9:
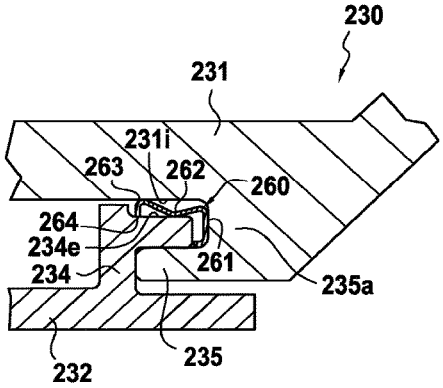
FIG. 9 is an axial section view of a third embodiment of the ring.

FIG. 9 shows a third embodiment of a turbine ring 230. In this third embodiment, the damper 260 is a flexible blade, preferably made of sheet metal, and it is substantially L-shaped in this axial section plane, being engaged around the distal portion of the hook 234 of the ring sector 232. The damper 260 has a plane portion 261 pressed against the radial portion 235*a* of the hook 235 of the ring support 231, with a generally tangential branch extending therefrom. In a first portion 262, this branch extends towards the inside so as to press against the outer surface 234*e* of the hook 234 of the sector 232, and then in a second portion 263, this branch extends towards the outside in such a manner as to press against the inner surface 231*i* of the support 231. Finally, this branch is folded radially inwards 264 so as to press at right angles against the outer surface 234*i* of the hook 234. The hook portion 234 of the sector 232 is thus pressed against the hook portion 235 of the support 231.

The embodiments described in the present description are given by way of non-limiting illustration, and a person skilled in the art, in the light of this description can easily modify these embodiments or envisage others, while remaining within the scope of the invention.

In particular, all of the embodiments described relate to a linked turbine of the turbine engine, however the teaching can also be applied to a free turbine. Likewise, the teaching can be transposed directly to the field of airplane turbojets.

Furthermore, the various characteristics of these embodiments can be used on their own or can be combined with one another. When they are combined, the characteristics may be combined as described above or in other ways, the invention not being limited to the specific combinations described in the present description. In particular, unless specified to the contrary, a characteristic described with reference to any one embodiment may be applied in analogous manner to any other embodiment.

The invention claimed is:

1. A turbine ring comprising:

a cylindrical support; and one or more sectors forming a circle configured to define a segment of an air passage, each sector being fastened to the support by an attachment device;

wherein the attachment device comprises a hook portion belonging to the support and projecting towards the sector, and a hook portion belonging to the sector and projecting towards the support, the hook portions of the support and of the sector being configured to co-operate in order to fasten the sector to the support;

a damper device provided within the attachment device and stressed radially between a portion of the sector and a portion of the support so as to damp relative movements between the sector and the support; and wherein the damper device comes into contact in alternation, in the circumferential direction, with an inner surface of the support and with an outer surface of the hook portion of the sector.

2. A ring according to claim 1, wherein the damper device comprises a flexible blade.

3. A ring according to claim 2, when said flexible blade is an element made of sheet metal.

4. A ring according to claim 1, wherein the damper device is stressed radially between said portion of the sector and said portion of the support over its entire length.

5. A ring according to claim 1, wherein the damper device is received at least in part in a groove formed in a portion of the sector.

6. A ring according to claim 1, wherein the damper device enfolds at least a distal portion of the hook portion of the support.

7. A ring according to claim 6, wherein the damper device is configured so as to maintain permanently, firstly at least one pressure zone on an outer surface of the hook portion of the support and a pressure zone on its inner surface, and secondly at least one of a pressure zone on the inner surface of the hook portion of the sector or a pressure zone on an outer surface of the sector.

8. A ring according to claim 1, wherein the damper device enfolds at least a distal portion of the hook portion of the sector.

9. A ring according to claim 1, wherein the damper device is divided into a plurality of sections that follow one another all along the circumference of the circle formed by the sector(s), a section preferably being associated with each sector.

10. A turbine engine including at least one ring according to claim 1.

11. A turbine ring comprising:

a cylindrical support; and one or more sectors forming a circle configured to define a segment of an air passage, each sector being fastened to the support by an attachment device;

wherein the attachment device comprises a hook portion belonging to the support and projecting towards the sector, and a hook portion belonging to the sector and projecting towards the support, the hook portions of the support and of the sector being configured to co-operate in order to fasten the sector to the support;

a damper device provided within the attachment device and stressed radially between a portion of the sector and a portion of the support so as to damp relative movements between the sector and the support; and wherein the damper device is configured so as to maintain permanently, firstly at least a pressure zone on an outer surface of the hook portion of the support or a pressure zone on an inner surface of the hook portion of the support, and secondly at least one of a pressure zone on an inner surface of the hook portion of the sector or a pressure zone on an outer surface of the sector.

* * * * *